US006684455B1

(12) United States Patent
Mertin

(10) Patent No.: US 6,684,455 B1
(45) Date of Patent: Feb. 3, 2004

(54) ARTICULATED JOINT, IN PARTICULAR A DOOR HINGE, HAVING A DEVICE FOR FASTENING A FIRST MOVEMENT ELEMENT

(75) Inventor: Ralf Mertin, Witten (DE)

(73) Assignee: ISE Industries GmbH, Witten (DE)

( * ) Notice: Subject to any disclaimer, the term of this patent is extended or adjusted under 35 U.S.C. 154(b) by 0 days.

(21) Appl. No.: 09/889,458

(22) PCT Filed: Jan. 12, 2000

(86) PCT No.: PCT/EP00/00159

§ 371 (c)(1),
(2), (4) Date: Oct. 15, 2001

(87) PCT Pub. No.: WO00/42280

PCT Pub. Date: Jul. 20, 2000

(30) Foreign Application Priority Data

Jan. 15, 1999 (DE) ..... 199 01 263

(51) Int. Cl.[7] ..... E05D 11/10

(52) U.S. Cl. ..... 16/334; 16/328; 16/337; 16/341

(58) Field of Search ..... 16/334, 328, 329, 16/330, 331, 332, 333, 337, 341, 345

(56) References Cited

U.S. PATENT DOCUMENTS 1,159,529 A * 11/1915 Parizek ..... 16/329
1,210,234 A * 12/1916 Towles ..... 16/334
2,635,281 A * 4/1953 Feldberg ..... 16/276
3,028,619 A * 4/1962 Schlage et al. ..... 16/49
4,377,020 A * 3/1983 Vigo ..... 16/329
4,829,633 A * 5/1989 Kassner ..... 16/322
6,282,752 B1 * 9/2001 Kluting et al. ..... 16/334
6,349,916 B1 * 2/2002 Lang et al. ..... 248/476

* cited by examiner

*Primary Examiner*—Gary Estremsky
*Assistant Examiner*—Mark Williams
(74) *Attorney, Agent, or Firm*—Leydig, Voit & Mayer, Ltd.

(57) ABSTRACT

The invention provides an articulated joint having a device for movably coupling a first movement element to a second movement element. The device comprises a fastening unit, which comprises at least one first braking element connected to the first movement element and at least one second braking element connected to the second movement element, a force application element which applies a force to at least one of the first or second braking elements, and a mechanical switching unit capable of taking up a coupling state and at least one separating state. The mechanical switching unit switches over from the coupling state into a separating state when the movement elements move relative to one another, and the mechanical switching unit deactivates the force applied by the force application element to at least one of the first or second braking elements when the mechanical switching unit is in the separating state.

34 Claims, 6 Drawing Sheets

ARTICULATED JOINT, IN PARTICULAR A DOOR HINGE, HAVING A DEVICE FOR FASTENING A FIRST MOVEMENT ELEMENT

The invention relates to an articulated joint, in particular a door hinge, having a device for fastening a first movement element which is coupled movably to a second movement element, having a fastening unit which has at least one first and one second braking element, the first braking element (for example, outer discs) being connected to the first movement element and the second braking element (for example, inner discs) being connected to the second movement element, the braking elements being able, by the action of a force generated by a force application element, to be engaged with one another in such a manner that they are fastened to one another, and via the connection of the braking elements to the movement elements, in this case the movement elements are also fastened to one another, and having a mechanical switching unit.

At present fastening devices are known which comprise a latching unit, which is connected in a rotationally fixed manner to a first movement element, and is in engagement with a latching projection mounted on a second movement element.

This type of fastening describes a mechanical door-holding system for motor vehicles which is customary in practice. These door-holding systems have defined latching points which are specified by the latching unit used. These latching points define the door-opening angles in which the position of the door, relative to the frame, is secured against slamming shut or opening. Fastening the door at any desired opening angle cannot be achieved using the known mechanical door-holding systems. In everyday life this has the consequence that in the event of an obstacle, for example another vehicle, a wall or the like, being situated in the predetermined latching position of the door, the door has to be fastened in the next smaller latching position, as a result of which, however, getting in or out is made substantially more difficult. Alternatively, there is only the option of holding the door open. However, this generally results in there being collisions with the object which result in unwanted damage.

A further disadvantage of the known door-holding systems resides in the fact that the doors are accelerated by their own latching system in the direction of the nearest latching. This has the result that the door, after being released outside the latching points, is accelerated in the direction of a possible obstacle and the door collides with the obstacle. Depending on the magnitude of the impact speed, these collisions cause damage, in particular damage to the paint, which has to be repaired at high cost.

Known catches which make it possible to lock the door in any desired position, require an electric or hydraulic auxiliary device in order to actuate braking elements which serve to fix the door. These systems are very susceptible to faults, have a high inherent weight and cause high manufacturing costs.

From document DE 41 03 198 a device is known which corresponds to the type of articulated joint the most important features of which are described in the beginning above. Said document discloses a door of a motor vehicle provided with a brake which holds the door in the open position. The brake consists of an arm attached to the hinge pin. The arm is provided with two radially adjustable blocks which have recesses to receive the rounded heads of brake shoes. Each brake shoe can swing around an axis, which is parallel to the hinge axis, and the brake shoe is in permanent contact with the inside surface of a bushing. Thus in case of a sufficient pressure between the brake shoe and the inside surface of the bushing to secure the desired opening position of the door it is not possible to freely pivot the door with respect to a frame because the pressure can not be reduced. Vice versa a reduction of the pressure which makes it possible to pivot the door with respect to the frame would have the undesired effect that the opening positions of the door are not sufficiently secured. Further a sufficient high pressure on the brake shoe, i.e. sufficiently high for holding the door, would necessarily cause a damage of the inside surface of the bushing.

It is therefore the object of the present invention to provide, with the abovementioned disadvantages being avoided, a fastening device of the type mentioned at the beginning which makes it possible for the movement elements to be locked in any desired relative position with respect to one another in a mechanical manner.

According to the invention, this object is achieved by use being made of the mechanical switching unit, which can take up a coupling state and at least one separating state, the switching unit switching over from the coupling state into the separating state when the movement elements move relative to one another, in the coupling state the switching unit releasing the action of a force on the braking elements, so that said braking elements enter into engagement with one another, and the switching unit comprising a first and second actuating element, the first actuating element (for example, upper lifting washer) being connected to the first movement element and the second actuating element (for example, lower lifting washer) being connected to the second movement element in such a manner that the movement of the movement elements causes a rotational movement of the actuating elements, which are mounted on one another in such a manner that when there is a mutual change in their position they execute a switching movement taking place in a direction which is parallel to the axis of rotation and the actuating elements change their distance apart which causes the switching unit to switch over from the coupling state into the seperating state in which the action of the force on the braking elements is blocked, so that said braking elements become detached from one another and at least one coupling element like a rolling or tilting body (for example balls) which converts the relative movement of the movement elements into a switching movement of the actuating elements, the coupling element returning automatically into its starting position releasing the action of the force on the braking elements, so that said braking elements reenter into engagement with one another.

Movement elements may be all of the parts which can be moved relative to one another and which are connected to one another. Movement elements can, in particular, be motor-vehicle doors which are connected to the vehicle body at a frame.

Locking of the movement elements with respect to one another, for example the fastening of a motor-vehicle door with respect to the body, takes place with the aid of the braking elements. These braking elements are connected to the associated movement elements in such a manner that the fastening of the braking elements leads to the fastening of the associated movement element.

In order to lock the movement elements in their relative position, the braking elements can be brought into mutual engagement. The type of connection between the particular braking elements can be selected in accordance with the particular application. Frictional or interlocking connections, inter alia, can thus be used.

In order to secure the connection of the engaged braking elements, said braking elements are acted upon with a force. The size of the force determines, inter alia, the counter-force which is necessary in order to detach the connection between the braking elements.

The mechanical switching unit, which is actuated by a movement of the movement elements relative to one another, is the central point of the invention. The movement of the movement elements causes the mechanical switching unit to be switched over from the coupling state, in which a force acts on the braking elements so that said braking elements enter into engagement with one another, into the separating state, as a result of which the action of the force on the braking elements is interrupted and the latter become detached from one another. Referring to the example of a motor-vehicle door, this means that by means of a door movement the mechanical switching unit switches from the coupling state into the separating state, by the door being freely pivotable with respect to the frame, until the pivoting movement of the door is at an end and the switching unit passes back into the coupling state in which it releases the force in order to fasten the braking elements.

Owing to this arrangement the automatic fastening and separating of the movement elements—i.e., for example, of the door with respect to the frame—is possible in every desired relative position. In this arrangement, the braking elements do not have to be brought into engagement or the braking elements which are in engagement do not have to be detached by a separate, external switching procedure if it is intended to fasten the movement elements or to move them relative to one another.

A coupling element is a body which can be arranged between the actuating elements and with which it is in point or linear or planar contact. A relative movement of the actuating elements causes the coupling elements to change their relative position with respect to the actuating elements, the distance between the actuating elements changing. Use can be made, among other things, of tilting bodies whose perpendicular extent changes by being inclined. In order to increase the distance between the actuating elements, the vertical extent of the coupling elements has to increase when they are tilted.

According to a preferred embodiment of the invention, the movement elements can be coupled displaceably and/or pivotably to one another. The type of coupling can be freely selected in accordance with the particular application. It is therefore possible to design the embodiment in such a manner that optimum adaptation to the given requirements is ensured. At the forefront in this case are design constraints which predetermine the type of embodiment.

According to a further refinement of the invention, the fastening unit and the mechanical switching unit can be arranged together in a housing. The elements arranged therein are thus protected against external influences. Such an arrangement of the fastening unit and mechanical switching unit permits a compact construction which is secured during the painting cycle and at the same time avoids necessary maintenance work, since environmental influences, such as dirt, dust, moisture etc., are also prevented from acting on the elements present in the device.

According to a development of the invention, the housing can be an integral part of a movement element or can be arranged thereon. The use of part of a movement element as the housing reduces the necessary space required. In addition, this refinement achieves a saving on weight on the entire system. Should, for design reasons, it not be possible to use an integral part of a movement element as the housing, there is alternatively the option of securing a separate housing on a movement element in a space-saving manner.

According to the invention, the force can be generated by a force-application element. The action of a force on the braking elements is necessary in order to ensure the required blocking of the two movement elements. In addition to the use of a force-application element which applies the force necessary for this, it is also, for example, possible to use the existing weight of a movement element. If a separate force-application element is used, it is possible to precisely meter the necessary force in order to obtain optimum functioning of the fastener.

According to a development of the invention, the force-application element can be a spring. In this case, helical springs or cup springs, in particular, can be used in a space-saving manner. The dimensioning of the spring allows adaptation to the required conditions.

According to the invention, the switching unit can have a first and second actuating element, the first actuating element being connected to the first movement element and the second actuating element being connected to the second movement element in such a manner that the actuating elements change their relative position with respect to one another when the movement elements move with respect to one another.

A corresponding connection of the actuating elements to the respective movement elements makes it possible to achieve a change in position of the actuating elements by means of a customary operation of the movement elements—for example, of a door with respect to a frame. The actuating elements form part of the switching unit and are connected directly to the movement elements. In a preferred embodiment, the actuating elements are formed by an upper and lower lifting washer. A mutual change in the position of the movement elements therefore causes a change in position of the actuating elements. In this arrangement, the movement elements can be connected to the actuating elements directly or via an intermediate gear mechanism. The use of a gear mechanism can contribute to facilitating the ease of operation if, for example, high forces occur in the system.

According to the invention, in the switching unit the actuating elements can change their distance apart and thereby can bring about a switching movement between the coupling state and the separating state. This change in distance enables the locking of the two movement elements to one another to be released because it leads to the power flow to the braking elements being interrupted.

According to a preferred embodiment of the invention, the first actuating element is arranged in a positionally fixed manner on the first movement element. A reduction in the number of movable parts reduces the risk of faults which may occur during the operation. Furthermore, a direct connection between the actuating element and movement element ensures a is problem-free transmission of force between the two elements.

According to a further refinement of the invention, the distance between the actuating elements can increase if they move with respect to one another from a first position, so that the second actuating element is, for example, raised if the two actuating elements are arranged one above the other. The arrangement of the actuating elements in the direction of the switching movements reduces the necessary overall size of the entire system.

According to a further refinement of the invention, the direction of the movement of the actuating elements, which movement is triggered by the movement of the movement elements, can be perpendicular to the direction of the switching movement. However, it is possible to change the orientation of the switching movement in accordance with the desired applications. An optimum refinement, in accordance with the particular application, of the invention is thus possible, the refinement being orientated to the given conditions, in particular space conditions.

According to the invention, the movement of the movement elements can cause a rotational movement of the actuating elements with respect to one another, the switching movement taking place in a direction which is parallel to the axis of rotation. If movement elements coupled pivotably to one another are used, the movement of the actuating elements therefore corresponds to the movements of the movement elements. It is therefore possible to dispense with possibly necessary changes in the direction of movement by means of complex gear mechanism constructions, which means a saving on weight, costs and space, amongst other things.

The advantageous refinements of the invention which are described in claims 9 and also 16 to 18 relate, among other things, to the type and arrangement of coupling elements and depressions on the actuating elements. The depressions serve in this case primarily to limit the inclination of the coupling elements and to position the coupling elements.

As an alternative to the use of separate switching elements, the actuating elements, which are designed as rings, can be of a corresponding design in their contact surface. In this case, it is, in particular, possible to provide the first actuating element in one piece as a profile with a projection, the projection interacting with a depression in the second actuating element.

By means of a corresponding shape of the depressions, it is also possible for rolling bodies which have a constant diameter to be used as coupling elements. The use of balls, for example, is thus possible if curved depressions are selected. When there is a relative movement of the actuating elements, the balls rise in the depressions and therefore increase the distance between the actuating elements.

The number of coupling elements and the associated depressions is orientated to the forces occurring during the switching. The force necessary for the switching is determined by the selection of the coupling elements and also by their arrangement on the actuating elements. It is thus possible to adjust the switching unit as desired in accordance with the stipulations via the coupling elements, among other things.

The advantageous refinements of the invention which are described in claims 10 to 15 relate, among other things, to the connection between the second actuating element and the second movement element. The refinements make provision for the second actuating element to be connected to the second movement element in a frictionally engaged manner. A thrust washer, which is arranged in a twist-proof and axially displaceable manner in the housing connected to the second movement element, can serve as the connecting element between the movement element and actuating element. In this embodiment of the invention, pivoting movements of the second movement element are transmitted directly to the thrust washer. The thrust washer, on the side which faces away from the actuating element, is subjected to pressure by the force which is applied, for example by a cup spring, which results in the formation of a frictionally engaged connection at a certain contact-pressure force between the second actuating element and the second movement element. That side of the second actuating element which is in contact with the thrust washer can have a sliding layer.

With an increasing change in distance between the actuating elements, the necessary force, which is necessary for a further change in distance, increases. In the process, in accordance with the selected pairing of material with the specified sliding layer, the stiction changes into the sliding friction state. The transition takes place after the switching movement is executed. In the sliding friction state, the force necessary for the relative change in position of the movement elements is reduced. It is possible, via the sliding layer, in conjunction with the position and type of coupling elements, to determine all of the forces necessary for the actuation.

According to a development of the invention, the first braking element can be connected in a twist-proof manner to the first movement element and the second braking element can be connected in a twist-proof manner to the second movement element. This embodiment of the invention relates, in particular, to movement elements which are connected in a rotationally hinged manner. In order to avoid a relative movement of the movement elements via the braking elements, it must be ensured that the braking elements do not move with respect to the movement elements. The fastening of the braking elements has to lead to the associated movement element being fastened. The braking elements should not be fixed perpendicularly to the direction of rotation, since the braking elements have to be moved relative to one another in order to be fastened or released and in order to execute a relative movement of the movement elements.

The advantageous refinements of the invention which are described in claims 20 to 23 relate, among other things, to the manner in which a thrust ring functions and to its interaction with brake discs which are used as the braking elements or as parts of said elements. The thrust ring is arranged in such a manner that in the coupling state it transmits the force from the thrust washer to the braking elements, so that the movement elements are fastened to one another. The thrust ring is understood to mean a component which, depending on the state of the switching unit, transmits the force from the thrust washer to the braking elements or separates them from the action of the force. In the event of the force transmission via the thrust washer, the braking elements, preferably brake discs, are pressed against one another, so that a frictional connection between the braking elements occurs.

In the separating state the second actuating element is displaced upwards, so that the frictional connection between the thrust washer and the thrust ring is interrupted and as a result the force is also prevented from acting on the discs.

The use of a thrust ring in conjunction with the thrust washer and also the use of the brake discs makes it possible to switch from the coupling state into the separating state in a minimal space.

When brake discs are used, there is the possibility of using one or more brake discs, depending on the application. It is additionally possible, by way of the selection of a suitable mating of material, to reduce the number of brake discs while retaining the desired locking force. In addition to the brake discs or else conical rings or cones which form a frictional connection, use can also be made of other braking elements, for example finely toothed braking elements, which form an interlocking connection.

The advantageous refinements of the invention which are described in claims 24 to 26 relate, inter alia, to the conversion of the described fastener to a frame-door system. When the first movement element is selected as a frame and the second movement element as a door which is pivotably coupled to the frame, the frame can be connected pivotably to the door via a hinge bolt, the hinge bolt extending in the housing. In such a refinement of the invention, the braking elements are in each case connected in a rotationally fixed manner to the hinge bolt or to the housing which is fixedly connected to the door. A spring arranged in the housing, for example, exerts pressure on the thrust washer, which is likewise secured in a rotationally fixed manner in the housing. During a pivoting movement, this thrust washer, in addition to the axial force component, transmits a rotational force to the associated actuating element which is in engagement with the actuating element of the hinge bolt via the coupling element.

A thrust ring arranged radially around the switching unit can transmit the axial force to the brake discs when the system is at a standstill, as a result of which said brake discs are brought into mutual engagement.

When applied to a preferred use and design of the invention, the following sequence is produced: at the beginning of a rotational movement of the door the distance between the actuating elements increases, as a result of which the spring-loaded thrust washer is displaced axially and the frictional connection between the thrust washer and thrust ring is interrupted. Since the counterforce, which holds the switching unit out towards the actuating force, increases as the relative movement of the actuating elements increases, at a defined position the thrust washer, as a consequence of the sliding layer, begins to slide, thereby enabling the door to pivot freely. Once the door is released, the distance between the actuating elements is reduced again, as a result of which the braking elements enter into engagement again and the door is fastened. The reduction in the distance between the actuating elements is associated with the door briefly pivoting back counter to the preceding direction of movement. This makes it possible to open the door virtually completely as far as an obstacle which may be present. Once the door is released, a margin of safety between the door and the obstacle is formed automatically by the restoring force of the door or manually by the door briefly pivoting back.

According to a preferred embodiment of the invention, a braking device, which is formed by the braking elements, is mounted directly on a hinge with which the movement elements are coupled pivotably to one another. This embodiment of the invention makes it possible, inter alia, for production costs to be reduced, since the fastener is not installed additionally to the existing hinges, but rather is integrated in one of the existing hinges.

According to a development of the invention, the housing can be configured in such a manner that in the closed state of the door the switching unit is fixed in the uncoupled state. As described previously, in the case of a door the switching unit switches in both directions of movement, i.e. both in the closing direction and in the opening direction. This would mean that the switching unit is fixed in the uncoupled state when the door is closed. However, this would have the consequence that when the door is opened, switching has to take place from the uncoupled state via the coupling state back into the uncoupled state. The development of the invention which is shown can prevent, when the door is opened, switching into the coupling state from taking place in the meantime. Via the angular range of which the bolt is in engagement with the second actuating element, the angular range can be determined in which the switching unit is blokked and therefore does not switch into the coupling state.

An exemplary embodiment of the invention is explained below with reference to the drawings. In the drawing:

FIG. 1 shows an exemplary embodiment of a device for the rotationally hinged connection and fastening of a first movement element, namely a door part 18, which is coupled rotatably to a second movement element, namely a pillar part 19 of a door frame.

Figure 1:
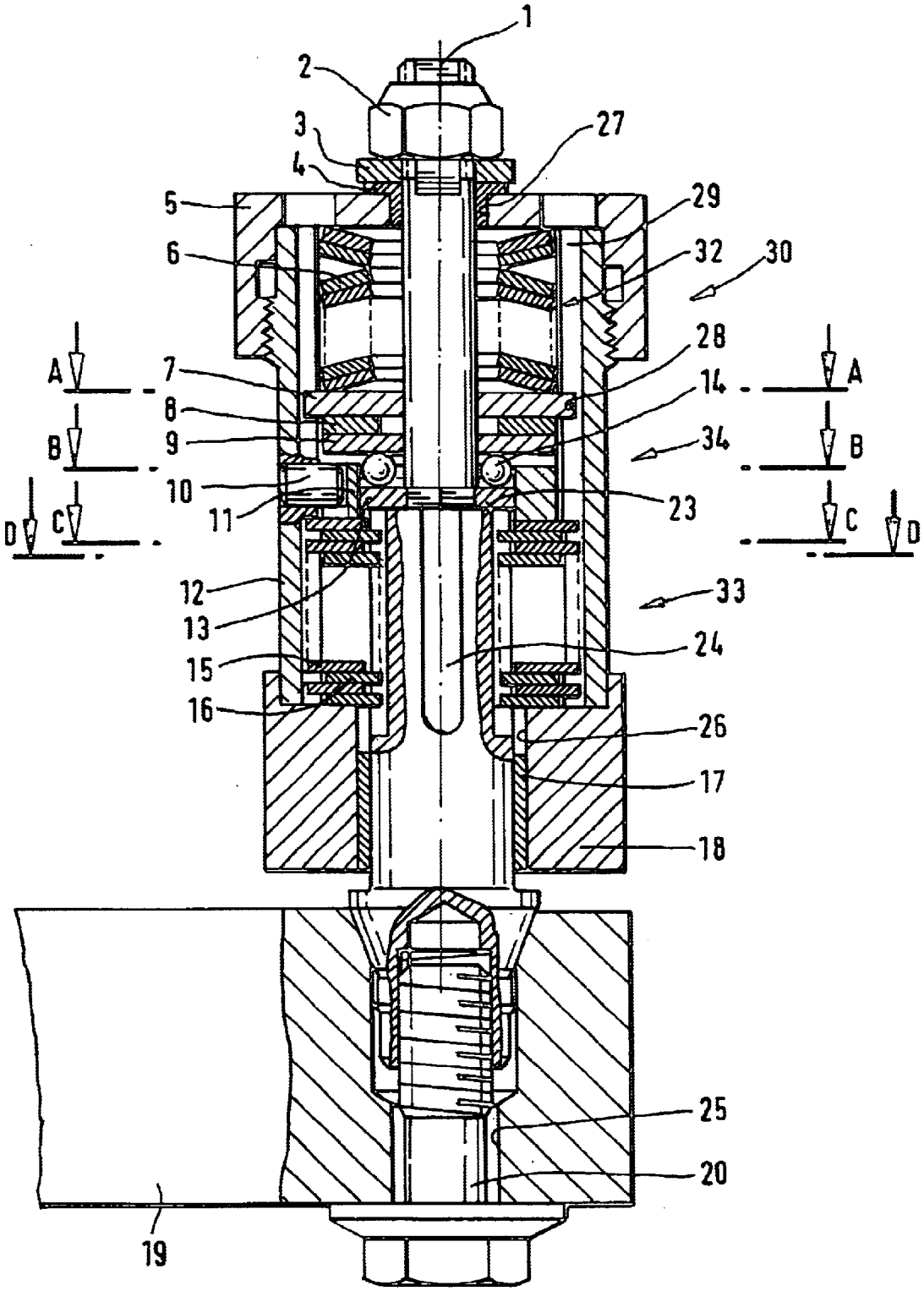
FIG. 1 shows a sectional representation of a device for the rotationally hinged connection of two movement elements, consisting of a door and a door frame with a fastener and with a switching unit.

A housing 30 is composed of a basic body 12, a cover 5 and the door part 18. The cylindrically shaped basic body 12 is closed on the side which faces a pillar part 19 by the door part 18, to which the basic body 12 is welded. In the axial extent of the central axis of the basic body 12 the door part 18 has a hole 26 in which a bearing bushing 17 is inserted. The bearing bushing 17 serves for radially guiding a hinge bolt 1 which extends within the housing 30.

On the side which faces away from the pillar part 19, a cover 5, which is welded to the basic body 12, closes the basic body 12. The cover 5 has, likewise in the axial extent of the central line of the housing 30, a hole 27 in which is inserted a flange bushing 4 which serves for absorbing radial and axial forces.

The pillar part 19 has a through-hole 25 for accommodating the hinge bolt 1. On the side which faces the door part 18, the through-hole 25 has a groove which runs inwards in a trapezoidal manner and serves for the arrangement of the hinge bolt 1 in a twist-proof manner. For this purpose, the lower region of the hinge bolt 1 is shaped in a corresponding manner to the trapezoidal groove. That end of the hinge bolt 1 which lies opposite the trapezoidal region has an external thread.

The hinge bolt 1 is pushed by the trapezoidally tapering region into that side of the through-hole 25 which faces the door part 18. A hexagon-head screw 20 is inserted into the through-hole 25 of the pillar part 19 on the side which is opposite the door part 18 and is screwed to the hinge bolt 1, as a result of which the latter is secured in a rotationally fixed manner on the pillar part 19.

The hinge bolt 1 extends through the housing 30 and protrudes out of the housing 30 from the cover 5. In order to secure the hinge bolt 1 in its position with respect to the housing 30, a hexagon nut 2 is screwed onto that end of the hinge bolt 1 which protrudes out of the cover 5. A ring 3 which is situated between the hexagon nut 2 and the cover 5 serves for securing purposes as an axial sliding surface for the flange bushing 4 and also for distance adjustment.

A plurality of cup springs 6 are arranged radially around the hinge bolt 1 within the housing and form a spring pillar 32. On the side which faces away from the pillar part 19, the spring pillar 32 is supported on the lower side of the cover 5 and with the opposite side subjects a thrust washer 7 to a spring force.

Figure 8:
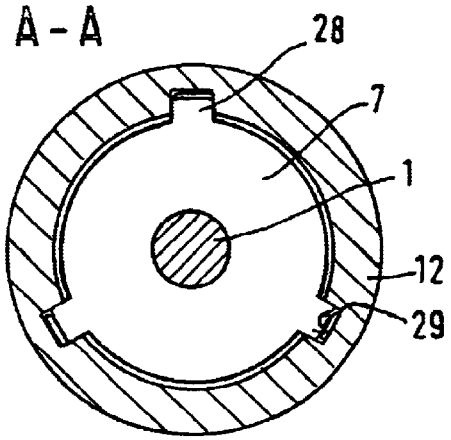
FIG. 8 shows a sectional representation of a detail from FIG. 1 along the intersecting line A—A.

The thrust washer 7 is a circular washer having a centrally arranged hole through which the hinge bolt 1 extends. The circumference of the thrust washer 7 has, preferably, three projections 28 by means of which the thrust washer 7 is guided axially in the housing. For this purpose, the inside of the basic body 12 has axially extending grooves 29 which serve for accommodating the projections 28 of the thrust washer 7 (cf. FIGS. 1 and 8).

The thrust washer 7, arranged in such a manner, is therefore arranged in the housing 30 in an axially displaceable and rotationally fixed manner. The thrust washer 7 transmits the spring force of the cup springs 6 to an upper lifting washer 9.

The upper lifting washer 9 is likewise formed by a circular washer which is provided,with a centrally arranged hole through which the hinge bolt 1 extends. In contrast to the thrust washer 7, the upper lifting washer 9 does not have any projections, so that the upper lifting washer 9 is arranged in the housing 30 in a rotatable and axially displaceable manner. On the side which faces the thrust washer 7, the upper lifting washer 9 has a bonded-on sliding layer 8. That side of the upper lifting washer 9 which faces away from the thrust washer 7 has, preferably, three depressions 21 which run radially outwards on the upper lifting washer 9 and have a curved cross section.

A lower lifting washer 13 is arranged opposite that side of the upper lifting washer 9 which has the depressions 21.

Figure 9:
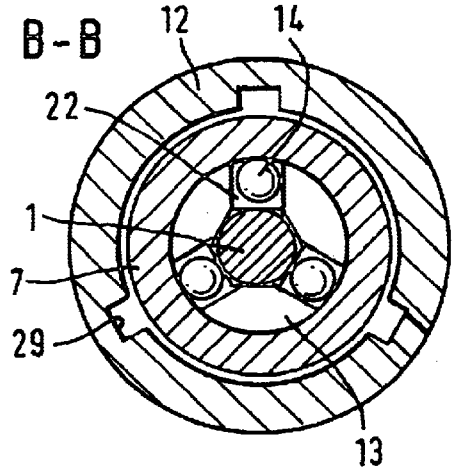
FIG. 9 shows a sectional representation of a detail from FIG. 1 along the intersecting line B—B.

The lower lifting washing 13 has a smaller diameter than the upper lifting washer 9. On the side which faces the upper lifting washer 9, the lower lifting washer 13 has depressions 22 whose arrangement corresponds to that of the depressions 21 of the upper lifting washer 9. In the centre of the lower lifting washer 13 there is situated a hexagonal opening by means of which the lower lifting washer 13 is secured against rotation on the hinge bolt 1. For this purpose, the shape of the hinge bolt 1, in a region above a shoulder 23 on which the lower lifting washer 13 rests, is of a corresponding hexagonal design (cf. FIG. 9).

Between the two lifting washers 9, 13 balls 14 are arranged in the region of the depressions 21, 22, which balls bring about a compressive frictional connection between the upper lifting washer 9 and the lower lifting washer 13 in the axial direction.

In the region below the upper lifting washer 9 lifting bolts 10, which protrude into the interior of the housing 30 below the upper lifting washer 9 are let into the wall of the basic body 12. On the edge region of its lower side, the upper lifting washer 9 has raised portions which can be brought into engagement with the lifting bolts 10.

A thrust ring 11 is arranged in the region around the lower lifting washer 13. The thrust ring 11 rests, by the side which faces the pillar part 19, on the upper side of outer discs 15 of a fastening unit 33, which outer discs 15 are arranged in the housing 30. The height of the thrust ring 11 is selected in such a manner that it is likewise in compressive frictional connection with the lower side of the upper lifting washer 9, if the balls 14 are situated in the lowest points of the depressions 21, 22 of the upper and lower lifting washer 9, 13 (cf. FIG. 2).

Figure 10:
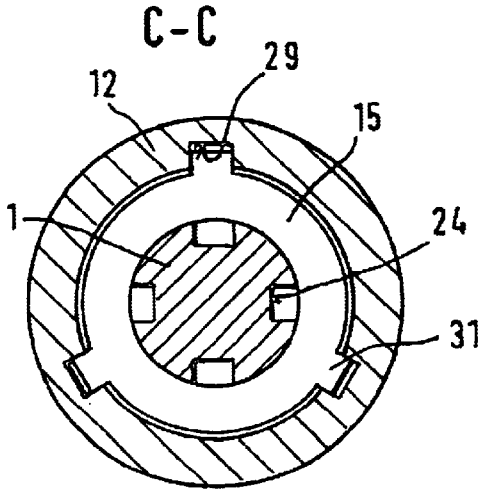
FIG. 10 shows a sectional representation of a detail from FIG. 1 along the intersecting line C—C.
Figure 11:
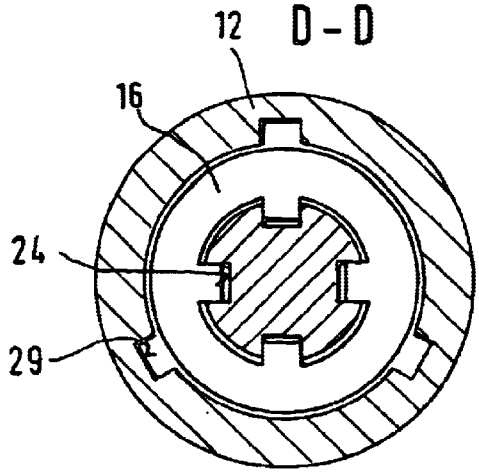
FIG. 11 shows a sectional representation of a detail from FIG. 1 along the intersecting line D—D.
Figure 12:
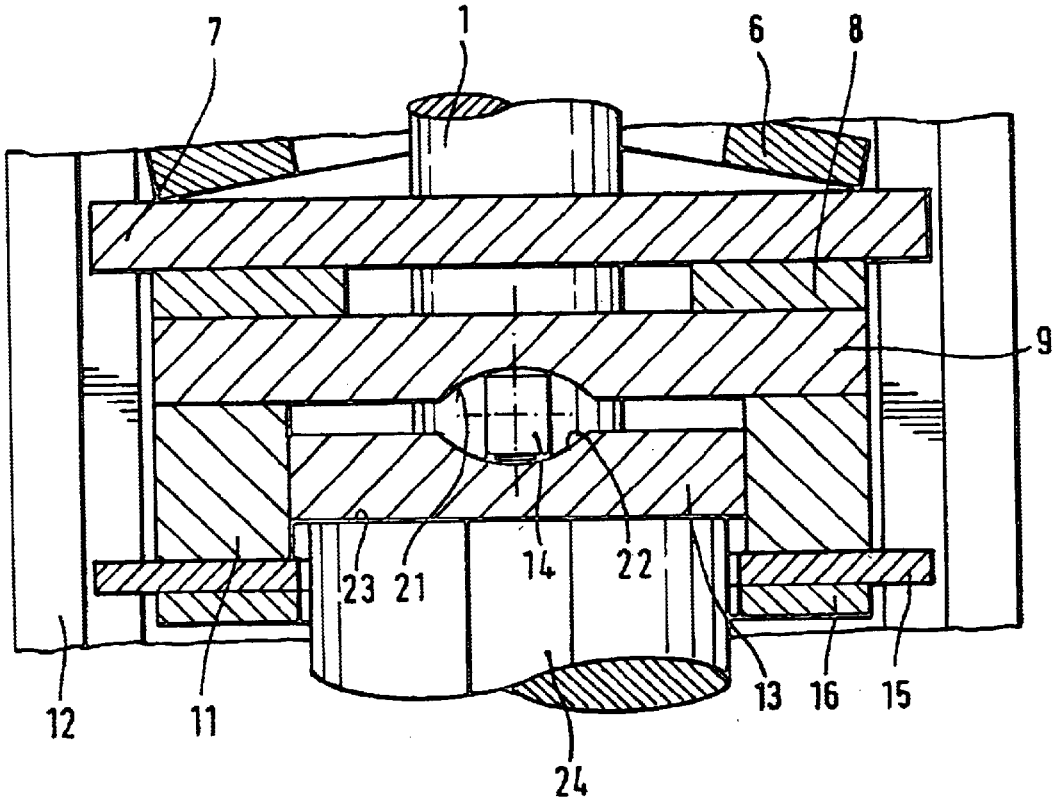
FIG. 12 shows a sectional representation of the mechanical switching unit incorporating a tilting body.

In the region below the shoulder 23 of the hinge bolt 1, the hinge bolt has four longitudinal grooves 24. The longitudinal grooves 24 serve for the twist-proof arrangement of inner discs 16 of the fastening unit 33, which inner discs have an opening in the centre, the profile of the opening corresponding to the cross section of the hinge bolt 1 in the region below the shoulder 23 (cf. FIG. 11). The inner discs 16 are arranged in alternate layers with the outer discs 15 in the housing 30. In order to fix the outer discs 15 in the housing 30 in a twist-proof manner, the said outer discs have, in a similar manner to the thrust washer 7, projections 31 which are guided in the grooves 29 which extend axially along the inside of the basic body 12 (cf. FIG. 10). If the thrust ring 11 transmits the force of the cup springs 6, the outer discs 15 and inner discs 16 are in mutual engagement, as a result of which the door part 18 is fixed on the pillar part 19.

Figure 2:
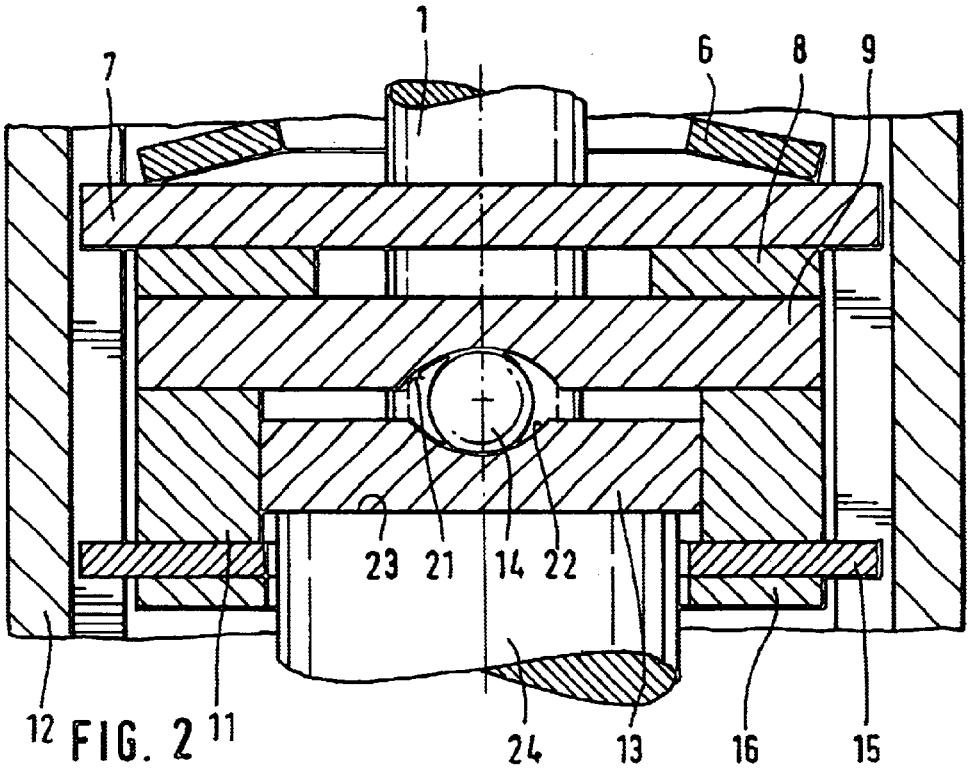
FIG. 2 shows a sectional representation of a mechanical switching unit in the coupling state.
Figure 3:
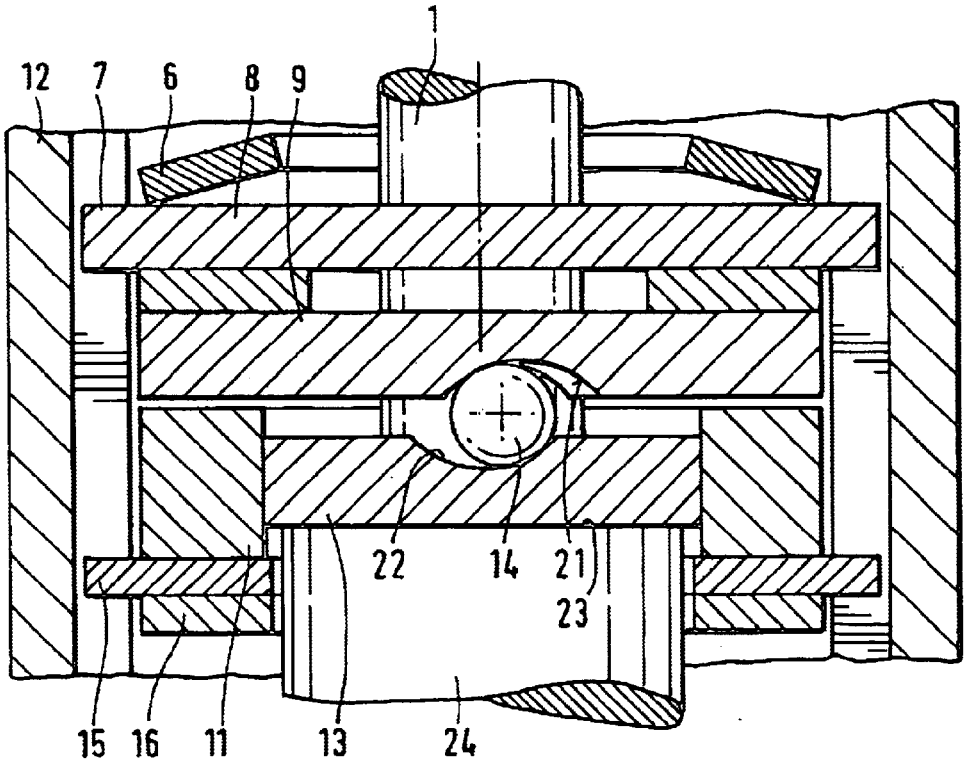
FIG. 3 shows a sectional representation of the mechanical switching unit in the separating state.
Figure 4:
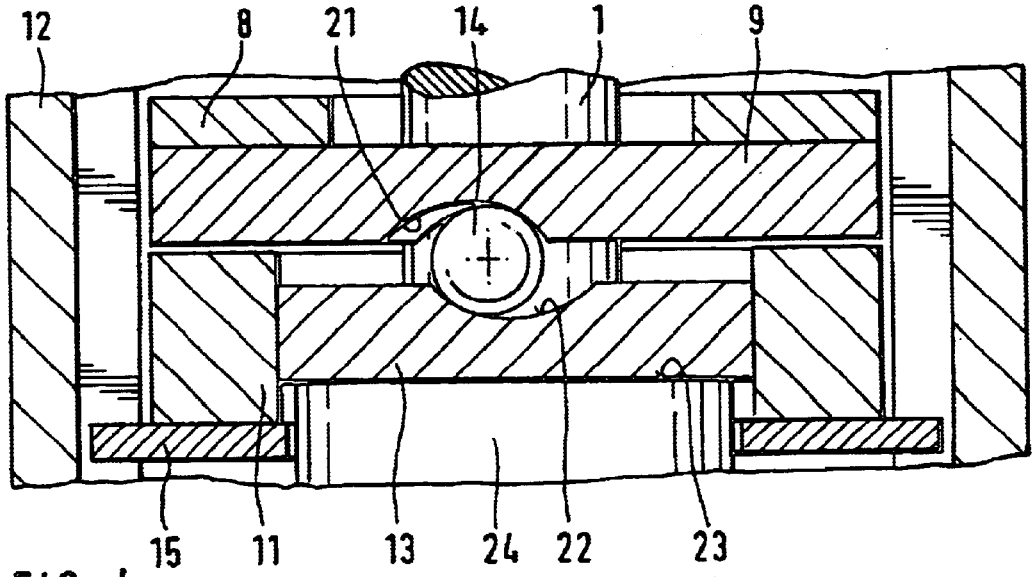
FIG. 4 shows a sectional representation of the mechanical switching unit in the separating state.

The sectional representations of a mechanical switching unit 34 in FIGS. 2–4 show the different positions which this mechanical switching unit 34 can assume. The position shown in FIG. 2 depicts a situation in which the switching unit is in the coupling state and the door part 18 and pillar part 19 are at rest with respect to each other.

In this position, in which the balls 14 are situated in the lowest points of the depressions 21, 22, the thrust washer 7 transmits the force of the cup springs 6 to the upper lifting washer 9. In this position the upper lifting washer 9 is in engagement with the thrust ring 11, as a result of which the spring force is transmitted to the outer discs 15. The spring force causes the outer discs 15 to be brought into engagement with the inner discs 16. Compression of the outer discs 15 and inner discs 16 produces a frictional connection between the door part 18 and the pillar part 19. The pillar part 19 and door part 18 are secured against rotation and against relative movement with respect to each other by the stiction which exists between the outer discs 15 and inner discs 16.

FIG. 3 depicts the situation of the mechanical switching unit 34, if the door part 18 and pillar part 19 move relative to each other. This situation arises if, proceeding from the situation which is represented in FIG. 2, the door part 18 is pivoted with respect to the pillar part 19. A pivoting movement causes the housing 30 to rotate, as a result of which the thrust washer 7 is rotated. This rotational movement is transmitted to the upper lifting washer 9 by means of the frictional connection. This causes the upper lifting washer 9 to be displaced relative to the lower lifting washer 13. This rotation causes the balls 14, which are arranged between the lifting washers 9, 13, to rise in their depressions 21, 22. The rising of the balls 14 causes an increase in the distance between the lifting washers 9, 13. By means of this increase in distance, the frictional connection between the upper lifting washer 9 and the thrust ring 11 is interrupted. This interruption causes the inner discs 16 and outer discs 15 which are in engagement to separate.

The increasing rise in the depressions 21, 22 and the increasing spring force causes an increase in the force which is necessary in order to rotate the upper lifting washer 9 with respect to the lower lifting washer 13. If the force which is necessary in order to increase the distance between the lifting washers 9, 13 exceeds the force produced from the product of the spring force and the stiction coefficients of the selected mating of material between the sliding layer 8 and the lower side of the thrust washer 7, the thrust washer 7 then begins to slip over the upper lifting washer 9, which enables the door part 18 to be pivoted in a simple manner with respect to the pillar part 19.

The position shown in FIG. 4 shows the opposite direction of movement to FIG. 3. If the position shown in FIG. 3 is taken as a closing movement of the door part 18, the position shown in FIG. 4 then shows the state during an opening movement.

Once a desired opening angle is reached, the state of stiction arises again as the movement between the upper lifting washer 9 and the thrust washer 7 eases off. After the door part 18 is released, the latter changes its opening angle minimally counter to the direction of movement-previously carried out. This is caused by the balls 14 rolling back in a force-assisted manner to the lowest point of the depressions 21, 22. In this situation, the brake discs 15, 16 are again in mutual engagement, so that the door part 18 is again secured against pivoting.

A change in the direction of movement means the transition from the position shown in FIG. 3 into the position shown in FIG. 4 or vice versa. For this purpose, however, the position shown in FIG. 2, in which the door part 18 is fixed with respect to the pillar part 19, has to be passed through each time.

This is also the case if the closed door, which is namely fixed in the position shown in FIG. 3, is opened.

Figure 5:
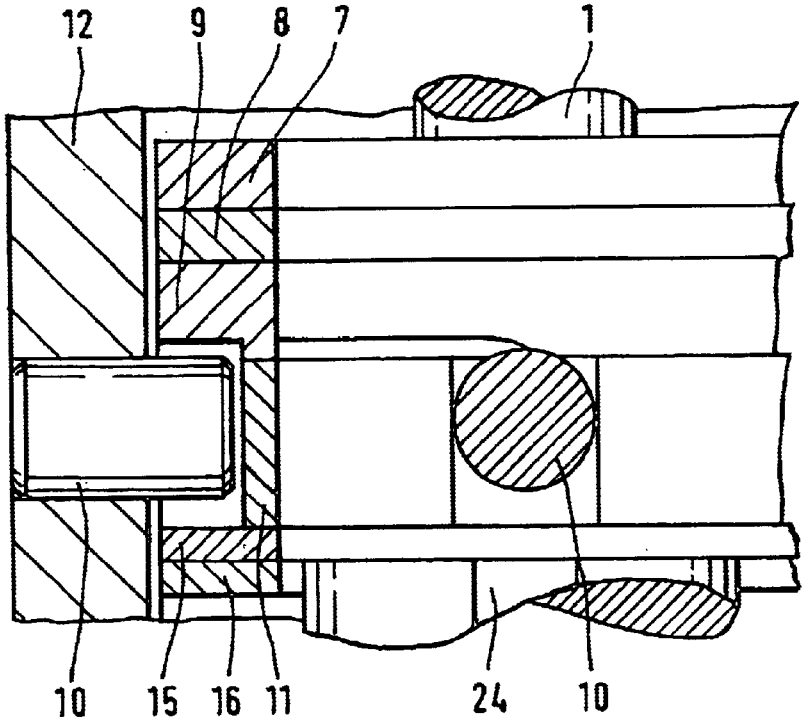
FIG. 5 shows a sectional representation of lifting bolts in interaction with an upper lifting washer.
Figure 6:
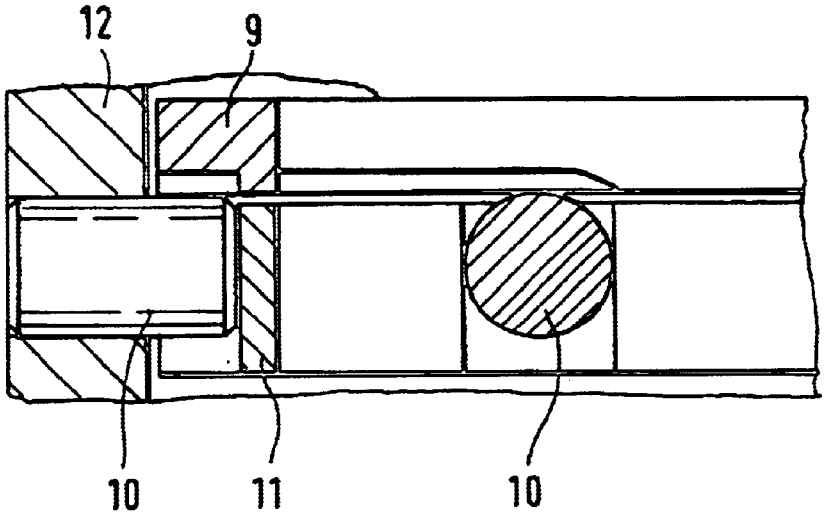
FIG. 6 shows a sectional representation of lifting bolts in interaction with an upper lifting washer.
Figure 7:
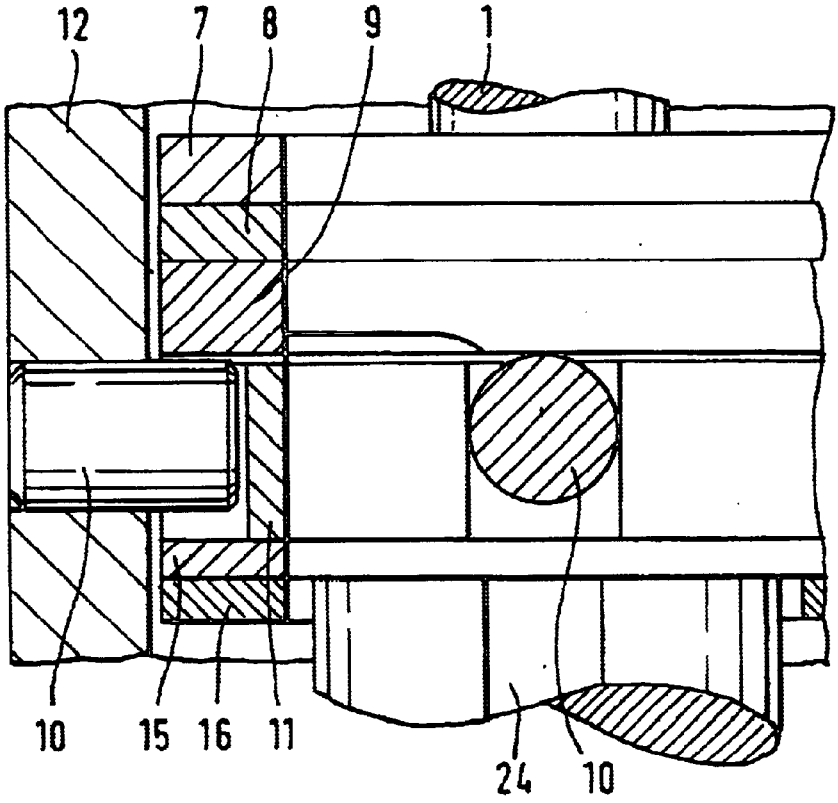
FIG. 7 shows a sectional representation of lifting bolts in interaction with an upper lifting washer.

In order to avoid the effect described above, the lifting bolts 10 grip under the raised portions of the upper lifting washer 9 in an angular range in which the door is closed. These lifting bolts 10 have the effect that when the door is opened, a direct transition from the position shown in FIG. 3 into the position shown in FIG. 4 is possible, without the braking position shown in FIG. 2 having to be passed through in the process. The angular range over which the raised portions extend determines the range in which the upper lifting washer 9 is locked in its raised position. Compare for this purpose, FIGS. 5 and 7 in which the procedure of "moving below the lifting washer" is shown step by step. FIG. 6 shows the situation in which the lifting bolts 10 are unstressed and the door is rotated in the opening direction without being braked. FIG. 5 shows the transition and FIG. 7 shows how the lifting bolts 10 are in engagement with the upper lifting washer 9.

Despite a reversal of movement in the lock region the door can therefore move out of said lock region without being braked.

What is claimed is:

1. An articulated joint for fastening a first movement element which, by means of the articulated joint, is movably coupled to a second movement element, comprising:

a fastening unit which has at least one first and one second braking element, the first braking element being connected to the first movement element and the second braking element being connected to the second movement element, the braking elements being able, by the action of a force generated by a force-application element, to be engaged with one another in such a manner that they are fastened to one another, such that the movement elements are also fastened to one another via the connection of the braking elements to the movement elements, a mechanical switching unit characterized in that the mechanical switching unit can take up a coupling state and at least one separating state, wherein the switching unit switches over from the coupling state into the separating state when the movement elements move relative to one another, and wherein, in the coupling state, the switching unit activates the force on the braking elements, so that the braking elements enter into engagement with one another, and wherein the switching unit further comprises a first and second actuating element, wherein the first actuating element is connected to the first movement element and the second actuating element is connected to the second movement element in such a manner that the movement of the movement elements causes a rotational movement of the actuating elements which are mounted on one another in such a manner that when there is a relative movement between them, they execute a switching movement taking place in a direction which is parallel to the axis of rotation such that the actuating elements move apart from each other, causing the switching unit to switch over from the coupling state into the separating state, in which the action of the force on the braking elements is overcome, so that the braking elements become detached from one another, and at least one coupling element that converts the relative movement of the movement elements into a switching movement of the actuating elements, and whereby, in the coupling state, the coupling element activates the force on the braking elements, so that the braking elements enter into engagement with one another.

2. The device according to claim 1, wherein the movement elements are coupled displaceably to one another.

3. The device according to claim 1, wherein the movement elements are coupled pivotally to one another.

4. The device according to claim 1, wherein the fastening unit and the mechanical switching unit are arranged in a housing.

5. The device according to claim 4, wherein the housing is an integral part of a movement element.

6. The device according to claim 4, wherein the housing is arranged on a movement element.

7. The device according to claim 1, wherein the force-application element is a spring.

8. The device according to claim 1 wherein the second actuating element is arranged in a positionally fixed manner on the second movement element.

9. The device according to claim 1, wherein the distance between the actuating elements increases if they move with respect to one another from the coupling state.

10. The device according to claim 9, wherein the actuating elements are arranged opposite one another and in each case have at least one depression which serves for accommodating at least one coupling element.

11. The device according to claim 10, wherein the first actuating element has an upper side and a lower side and is connected to the first movement element in a frictionally engaged manner.

12. The device according to claim 11, wherein the upper side of the first actuating element, which side faces away from the second actuating element, has a sliding layer.

13. The device according to claim 12, wherein the sliding layer of the first actuating element is in planar contact with a thrust washer that has an upper side and lower side.

14. The device according to claim 13, wherein the thrust washer is arranged in a non-rotational and axially displaceable manner in the housing.

15. The device according to claim 14, wherein the lower side of the thrust washer, together with the upper side of the first actuating element, form a frictionally engaged connection between the first movement element and the first actuating element.

16. The device according to claim 15, wherein the thrust washer, on the side which faces away from the first actuating element, is acted upon by the force.

17. The device according to claim 10, wherein the coupling element is arranged between the actuating elements.

18. The device according to claim 17, wherein the coupling element is a rolling body.

19. The device according to claim 18, wherein the depressions are designed in such a manner that the rolling body rises in the depressions if the actuating elements execute a rotational movement relative to one another.

20. The device according to claim 1, wherein the direction of the movements of the actuating elements, which movements are triggered by the movement of the movement elements, is approximately perpendicular to the direction of the switching movement.

21. The device according to claim 1, wherein the coupling element is a tilting body.

22. The device according to claim 1, wherein the coupling element is a projection with a profile, and the lower actuating element has a depression which interacts with the projection in order to execute the sliding movement.

23. The device according to claim 1, wherein the first braking element is connected in a non-rotational manner to the first movement element and the second braking element is connected in a non-rotational manner to the second movement element.

24. The device according to claim 23, wherein a thrust ring is arranged in such a manner that in the coupling state it transmits the force from the thrust washer to the braking elements in such a manner that the movement elements are fastened to one another.

25. The device according to claim 24, whereby, in the separating state, the first actuating element is displaced upwards, so that it is positioned a distance above the thrust ring and absorbs the force.

26. The device according to claim 1, wherein the braking elements are arranged next to one another and become frictionally engaged by pressing against one another.

27. The device according to claim 26, wherein the braking elements have one or more brake discs.

28. The device according to claim 1, wherein the second movement element has a pillar part and the first movement element is a door part which is coupled pivotably on said pillar part.

29. The device according to claim 28, wherein the pillar part is connected pivotably to the door part via a hinge bolt.

30. The device according to claim 29, wherein the hinge bolt extends in the housing.

31. The device according to claim 30, wherein the fastening unit, which is formed by the braking elements, is mounted directly on a hinge with which the movement elements are coupled pivotably to one another.

32. The device according to claim 31, wherein the housing is configured in such a manner that in the closed state of the door part the switching unit is fixed in the uncoupled state.

33. The device according to claim 32, further including a lifting bolt mounted on the housing, and a closed state, wherein the lifting bolt moves the first actuating element a distance from the second actuating element.

34. An articulated joint for movably coupling a first movement element to a second movement element comprising:

a fastening unit comprising at least one first braking element connected to the first movement element and at least one second braking element connected to the second movement element, a force application element which applies a force to at least one of the first or second braking elements so that the first and second braking elements engage one another in such a manner that they are fastened to one another and the movement elements are fastened to one another via the connection of the braking elements to the movement elements, and a mechanical switching unit capable of taking up a coupling state and at least one separating state, wherein the mechanical switching unit switches over from the coupling state into a separating state when the movement elements move relative to one another and returns to the coupling state when the relative movement of the movement elements ceases, wherein the force application element applies the force to at least one of the first or second braking elements when the mechanical switching unit is in the coupling state, and wherein the mechanical switching unit deactivates the force applied by the force application element to at least one of the first or second braking elements when the mechanical switching unit is in the separating state.

* * * * *